US008417143B2

(12) United States Patent
Nakajima

(10) Patent No.: US 8,417,143 B2
(45) Date of Patent: Apr. 9, 2013

(54) IMAGE FORMING APPARATUS WITH CHARGING DEVICE OF CORONA TYPE

(75) Inventor: Masanobu Nakajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 493 days.

(21) Appl. No.: 12/619,814

(22) Filed: Nov. 17, 2009

(65) Prior Publication Data

US 2010/0135682 A1 Jun. 3, 2010

(30) Foreign Application Priority Data

Nov. 28, 2008 (JP) ..... 2008-304029
Oct. 9, 2009 (JP) ..... 2009-235086

(51) Int. Cl.
*G03G 15/02* (2006.01)

(52) U.S. Cl. ..... 399/100; 399/50; 399/170; 399/206; 399/207

(58) Field of Classification Search ..... 399/50–52, 399/168, 206, 207, 100, 170
See application file for complete search history.

(56) References Cited

U.S. PATENT DOCUMENTS

| | | | | |
|---|---|---|---|---|
| 7,599,642 | B2 | 10/2009 | Nakajima et al. | |
| 8,036,565 | B2 | 10/2011 | Nakajima et al. | |
| 2006/0083527 | A1 * | 4/2006 | Sakamaki | 399/50 |
| 2006/0269324 | A1 * | 11/2006 | Wagner et al. | 399/170 |
| 2007/0118275 | A1 | 5/2007 | Qi et al. | |
| 2008/0038011 | A1 * | 2/2008 | Nakajima et al. | 399/100 |
| 2009/0136253 | A1 | 5/2009 | Nakajima et al. | |
| 2011/0286767 | A1 | 11/2011 | Nakajima et al. | |

FOREIGN PATENT DOCUMENTS

| | | | |
|---|---|---|---|
| EP | 2 192 451 | A1 | 6/2010 |
| JP | 2-193158 | A | 7/1990 |
| JP | 7-104564 | A | 4/1995 |
| JP | 2001-175058 | A | 6/2001 |
| JP | 2008-46297 | A | 2/2008 |
| JP | 2008-116724 | A | 5/2008 |
| JP | 2008-145565 | A | 6/2008 |
| JP | 2008-145851 | A | 6/2008 |

OTHER PUBLICATIONS

Decision on Grant of a Patent for Invention dated Apr. 25, 2011, in counterpart Russian Application No. 2009144108/28(062741).
Notification of First Office Action dated Jul. 25, 2011, in Chinese Application No. 200910225556.X.
Communication dated Mar. 8, 2010, and a European Search Report, date of completion Mar. 1, 2010, in counterpart European Application No. 09177201.2-2209.
Office Action mailed Mar. 20, 2012, in Korean Application No. 10-2009-0115613.
Korean Office Action mailed Dec. 7, 2012, in Korean Application No. 10-2009-0115613.

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes a rotatable photosensitive member; a corona charger provided with an opening opposed to a surface of the photosensitive member; image forming means for forming a toner image on the photosensitive member; a shutter for opening and closing the opening relative to the photosensitive member; sliding means for sliding in contact with the photosensitive member; measuring means for measuring time elapsed from end of image formation; and control means for controlling the apparatus on the basis of an output of the measuring means such that shutter is closed and the photosensitive member is rotated in contact with the sliding means.

10 Claims, 6 Drawing Sheets

IMAGE FORMING APPARATUS WITH CHARGING DEVICE OF CORONA TYPE

FIELD OF THE INVENTION AND RELATED ART

The present invention relates to an image forming apparatus, such as a printer, a copying machine, and a facsimile machine, which is equipped with a charging device of the corona type.

Electrophotographic image forming apparatuses are equipped with a charging device for charging a photosensitive member. Further, some electrophotographic image forming apparatuses are equipped with a charging device of the corona type. Thus, in the case of an electrophotographic image forming apparatus equipped with a charging device of the corona type, byproducts of electrical discharge, such as ozone ($O_3$), nitrogen oxides ($NO_x$), are generated by the corona discharge which occurs as a photosensitive member is charged by the charging device of the corona type. Some of the byproducts resulting from the corona discharge accumulate on the peripheral surface of the photosensitive member. Thus, if an electrophotographic image forming apparatus equipped with a charging apparatus of the corona type is used in a high humidity environment, the byproducts on the peripheral surface of the photosensitive member are likely to absorb the moisture from the air, and therefore, the portions of the peripheral surface of the photosensitive member, across which the byproducts have accumulated, sometimes reduce in electrical resistance. As the peripheral surface of the photosensitive member of the image forming apparatus reduces in electrical resistance, the electrical charge for image formation is likely to drain from the image forming portion of the peripheral surface of the photosensitive member. If the electrical charge drains from the image forming portion of the peripheral surface of the photosensitive member by a significant amount, the image forming apparatus forms an unsatisfactory image, that is, an image which is blurry and/or dim. It has been known that while images are actually formed, the byproducts of electrical discharge are removed by a cleaning member, for example, a cleaning blade, which is placed in contact with the photosensitive member, and therefore, it is unlikely to occur that electrical charge is drained from the image forming portion of the peripheral surface of the photosensitive member by a significant amount because of the presence of the byproducts of electrical discharge.

It has also been known, however, that during a night, or any time of a day, when an electrophotographic image forming apparatus is not used for a long time, the byproducts of electrical discharge, which have adhered to the inward side of the shielding plate of a charging device of the corona type, become problematic. More concretely, during a night, or any time of the day, when the image forming apparatus is not used for a long time, the byproducts of electrical discharge, which have adhered to the inward surface of the shielding plate of the charging device of the corona type, evaporate (separate from plate), reach the photosensitive member through the charging opening of the charging device, and accumulate on the photosensitive member. As a result, the portion of the peripheral surface of the photosensitive member, which faces the charging opening of the charging apparatus of the corona type, is reduced in electrical resistance.

Thus, Japanese Laid-open Patent Application H02-193158 discloses an image forming apparatus devised to deal with the above described problem. That is, if this image forming apparatus is left unused longer than a preset length of time, it inserts a shutter (shielding member) between its charging device and photosensitive drum, in order to prevent the byproducts of electrical discharge, which cause the formation of an unexpectedly blurry and/or dim image, from falling from the charging device onto the photosensitive member. That is, providing the charging device of the corona type with a shutter can prevent the byproducts of electrical discharge, which have adhered to the inward surface of the shield plate of the charging device, from accumulating on the peripheral surface of the photosensitive member, and therefore, can prevent the formation of an unexpectedly blurry and/or dim image. In a case where the formation of an unexpectedly blurry and/or dim image is prevented by the provision of the abovementioned shutter, it is desired that the shutter is kept shut while no image is formed. More concretely, it is desired that the shutter is opened only as an image formation signal is inputted, and also, that the shutter is closed as soon as an image forming operation is completed.

The above described setup, however, has the following problem. That is, if an image forming apparatus is set up so that its drum shutter is opened as an image formation signal is inputted, an image cannot be formed until the shutter becomes fully open. This problem is exacerbated in the case of an image forming apparatus structured to open or close its drum shutter in the direction parallel to the lengthwise direction of its photosensitive member. That is, it takes a longer time to open or close the shutter in the direction parallel to the lengthwise direction of the photosensitive member than in the direction intersectional to the lengthwise direction of the photosensitive member. In other words, structuring an image forming apparatus so that its shutter is opened after the inputting of an image formation signal makes unnecessarily long the length of time it takes for an image forming apparatus to start forming an image after the pushing of a start button, and therefore, reduces the image forming apparatus in productivity.

SUMMARY OF THE INVENTION

As one of the solutions to the above described problem, it is possible to structure an image forming apparatus so that its drum shutter remains opened for a preset length of time after the completion of an image forming operation, and then, is closed after the elapse of the preset length of time. This structural arrangement makes it possible to reduce the amount of electric power used to heat the photosensitive drum with a heater to prevent the formation of an unexpectedly blurry and/or dim image, and/or reduce the length of time the photosensitive member is rotated to remove the byproducts of electrical discharge.

However, the above described solution keeps the drum shutter open for a preset length time, making it possible for the byproducts from the charging device of the corona type to accumulate on the photosensitive member while the shutter is kept open. Thus, it is possible that as an image formation signal is inputted next time to form an image by opening the drum shutter, electrical charge will be drained by a significant amount from the image forming portion of the peripheral surface of the photosensitive member, although whether or not the draining of electric charge by a significant amount occur depends of the conditions of the environment in which the image forming apparatus is operated.

According to an aspect of the present invention, there is provided an image forming apparatus comprising a rotatable photosensitive member; a corona charger provided with an opening opposed to a surface of said photosensitive member; image forming means for forming a toner image on said photosensitive member; a shutter for opening and closing said opening relative to said photosensitive member; sliding means for sliding in contact with said photosensitive member; measuring means for measuring time elapsed from end of image formation; and control means for controlling said apparatus on the basis of an output of said measuring means such that shutter is closed and said photosensitive member is rotated in contact with said sliding means.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Hereinafter, the image forming apparatus in the first preferred embodiment of the present invention will be described in detail with reference to the appended drawings. However, the measurements, materials, and shapes of the structural components of the image forming apparatus in this embodiment, and the positional relationship among them, are not intended to limit the present invention in scope, unless specifically noted. Further, the "draining of electrical charge by a significant amount from the peripheral surface of the photosensitive drum", which results in the formation of an unexpectedly blurry and/or dim image, means the phenomenon that the electrical charge on the portion of the peripheral surface of the photosensitive drum reduces by a significant amount because the electrical resistance of its peripheral surface reduces due to the presence of the byproducts of electrical discharge on its peripheral surface.

1. Image Forming Apparatus

Figure 1:
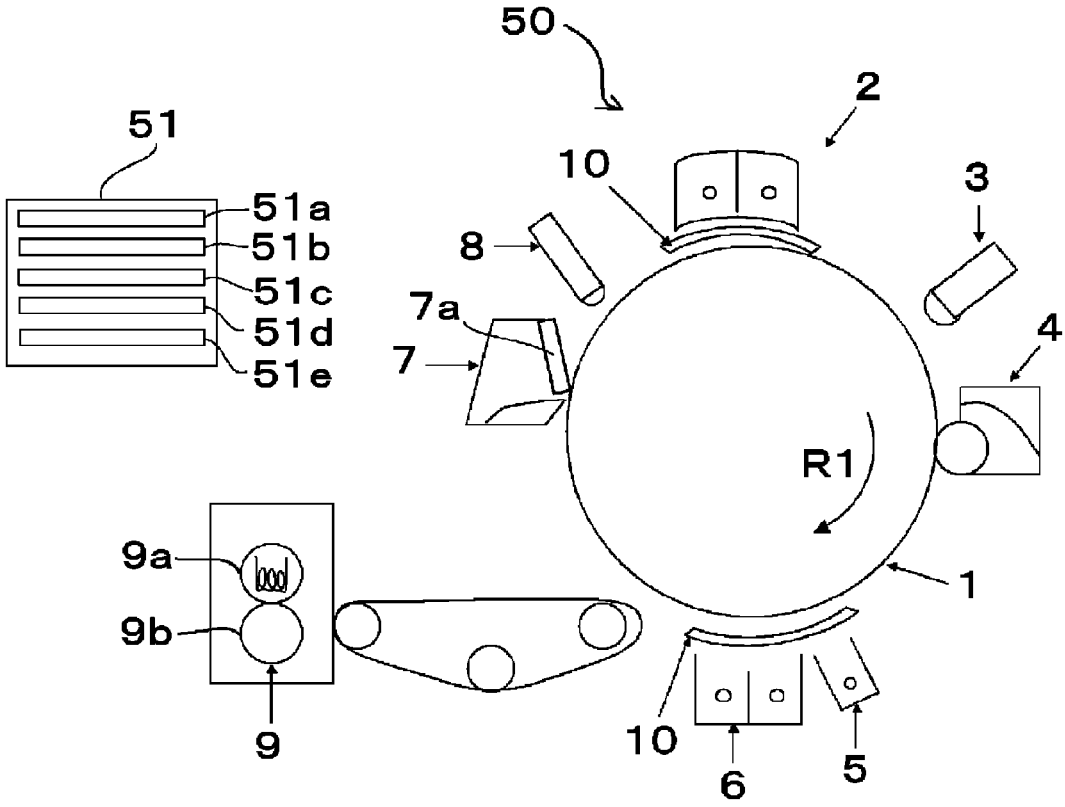
FIG. 1 is a sectional view of the image forming apparatus in the first preferred embodiment of the present invention.

FIG. 1 is a sectional view of the image forming apparatus in the first preferred embodiment of the present invention, and shows the structure of the image forming apparatus. The image forming apparatus 50, shown in FIG. 1, is an electrophotographic image forming apparatus. The image forming apparatus 50 is equipped with an electrophotographic member 1, which is in the form of a drum (which hereafter will be referred to as photosensitive drum). The photosensitive drum 1 is supported so that it can be rotated in the direction indicated by an arrow mark R in the drawing. The image forming apparatus 50 is also equipped with a primary charging device 2, an exposing device 3, a developing device 4, a transfer charging device 5, a separation charging device 6, a cleaning device 7 having a cleaning blade 7*a*, and a pre-exposing device 8. These devices are disposed in the adjacencies of the peripheral surface of the photosensitive drum 1, in the listed order in terms of the rotational direction of the photosensitive drum 1. The primary charging device 2, transfer charging device 5, and separation charging device 6 are disposed so that they face the peripheral surface of the photosensitive drum 1. The primary charging device 2 is used to uniformly charge the peripheral surface of the photosensitive drum 1. The exposing apparatus 3 and developing device 4 function as the means for forming a toner image on the photosensitive drum 1. The cleaning device 7 has the cleaning blade 7*a*, which is disposed so that it can be placed in contact with the photosensitive drum 1. It is structured so that the cleaning blade 7*a* cleans the photosensitive drum 1 by rubbing the photosensitive drum 1. The image forming apparatus 50 is also provided with a fixing apparatus 9, which is located where a sheet of recording medium is conveyed after the transfer of an image from the photosensitive drum 1 onto the sheet of recording medium. The fixing apparatus 9 has a fixation roller 9*a* and a pressure roller 9*b*. Further, the image forming apparatus 50 is provided with a charging device shutter 10, as a photosensitive drum shielding member, which can be placed between the primary charging device 2 (charging device of corona type), and the photosensitive drum 1 (photosensitive member), or can be moved out from between the primary charging device 2 and photosensitive drum 1. That is, the image forming apparatus 50 is structured so that the charging means shutter 10 can keep the charging opening of the primary charging device 2 opened or closed. Similarly, the image forming apparatus 50 is structured so that the charging device shutter 10 can be inserted into the space between the transfer charging device 5 (charging device of corona type) and the peripheral surface of the photosensitive drum 1, and also, the space between the separation charging device 6 (charging device of corona type), or can be moved out therefrom. That is, the image forming apparatus 50 is structured so that the charging device shutter 10 can keep the opening of the transfer charging device 5, and the opening of the separation charging device 6, opened or closed. Further, the cleaning device 7, as a cleaning means, is provided with the cleaning blade 7*a*, which is a foreign substance removing member in the form of a blade.

The image forming apparatus 50 is also provided with a controller 51, which is a means for controlling the image forming apparatus 50. The controller 51 is provided with a shutter detecting means 51*a*, a measuring means 51*b*, a cleaning means activating means 51*c*, a setting means 51*d*, and an altering means 51*e*. The shutter detecting means 51*a* is the means for detecting the position of the charging device shutter 10. The measuring means 51*b* is the means for measuring the length of the time which elapses after the completion of an image. The cleaning means activating means 51*c* is the means for closing the charging device shutter, in response to the output of the measuring means 51*b*. It is also the means for start rotating the photosensitive drum to make the cleaning device 7 clean the peripheral surface of the photosensitive drum by rubbing it, before starting to close the charging device shutter 10. The setting means 51*d* is the means for variably setting the length of the time between the completion of an image forming operation, and the start of the closing of the charging device shutter 10. The altering means 51*e* is the means for changing the length of the time the photosensitive drum 1 is rubbed (for cleaning) by the cleaning device 7 before the closing of the charging device shutter 10, in response to the length of time set by the setting means 51*d*.

During an image forming operation, the photosensitive drum 1 of the image forming apparatus 50 is rotationally driven by a driving means in the direction indicated by the arrow mark R1 at a preset peripheral velocity. As the photosensitive drum 1 is rotationally driven, the peripheral surface of the photosensitive drum 1 is uniformly charged by the primary charging device 2 to a potential level of 400 V. After the charging of the peripheral surface of the photosensitive drum 1, the peripheral surface of the photosensitive drum 1 is scanned by a beam of light, which is projected by the exposing device 3 while being modulated with the image formation information. As a given point of the uniformly charged portion of the peripheral surface of the photosensitive drum 1 is exposed to the beam of light, electrical charge is removed from this point. As a result, an electrostatic image is formed on the peripheral surface of the photosensitive drum 1. This electrostatic image is developed by the developing device 4, into an image formed of toner; toner adheres to various points of the electrostatic image, from which electrical charge was removed. As the developer, nonmagnetic developer made up of a single component, for example, can be used. After the formation of the toner image on the peripheral surface of the photosensitive drum 1, the toner image is conveyed by the rotation of the photosensitive drum 1 in the direction indicated by the arrow mark R1, to the transfer area, which is between the photosensitive drum 1 and transfer charging device 5. Meanwhile, a sheet of recording medium is delivered to the transfer area, with the same timing as the arrival of the toner image at the transfer area. As the toner image and sheet of recording medium are conveyed through the transfer area, a transfer bias, which is opposite in polarity to the toner image, is applied between the photosensitive drum 1 and transfer charging device 5. As a result, the toner image on the photosensitive drum 1 is transferred onto the sheet of recording medium by the electrostatic force between the photosensitive drum 1 and transfer charging device 5.

After the transfer of the toner image, the sheet of recording medium is separated from the photosensitive drum 1 by the separation bias applied by the separation charging device 6. Then, the sheet of recording medium is conveyed to the fixing device 9. As the sheet of recording medium arrives at the fixing device 9, it is conveyed between the fixation roller 9*a* and pressure roller 9*b*. As the sheet of recording medium is conveyed between the two rollers 9*a* and 9*b*, the sheet of recording medium and the toner image thereon are subjected to heat and pressure. As a result, the toner image is fixed to the surface of the sheet of recording medium. Then, the sheet of recording medium is discharged from the image forming apparatus 50. Meanwhile, the transfer residual toner, that is, the toner which was not transferred onto the sheet of recording medium during the above described transferring process, and therefore, remaining on the peripheral surface of the photosensitive drum 1 after the transfer of the toner image, is removed by the cleaning device 7. Further, the electrical charge remaining on the peripheral surface of the photosensitive drum 1 is removed by the pre-exposing apparatus 8. Then, the photosensitive drum 1 is used for the following image formation cycle.

2. Shutter Structure

Figure 2:
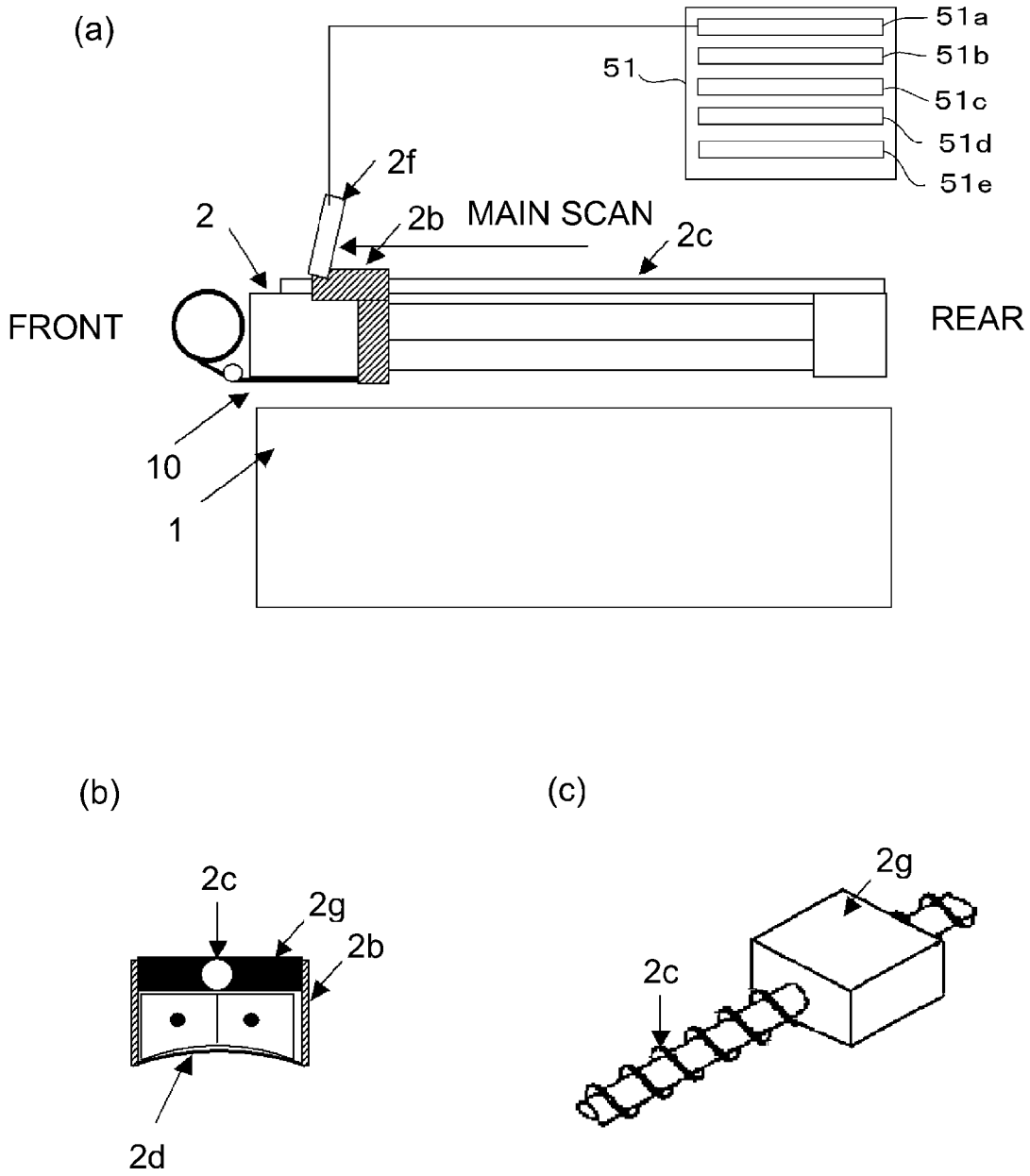
FIGS. 2(*a*), 2(*b*), and 2(*c*) are side, sectional, and perspective views of the primary charging device having a shutter, in the first preferred embodiment of the present invention.

FIG. 2(*a*) is a side view of the primary charging device 2, which has the charging device shutter 10. It shows the general structure of the primary charging device 2. The primary charging device 2 is provided with a rotational member 2*c* which extends in parallel to the axial line of the photosensitive drum 1, and a shutter driving device 2*b*, as shown in FIG. 2(*a*). The primary charging device 2 is structured so that the shutter driving device 2*b* is movable in the direction (primary scanning direction) which is parallel to the rotational member 2*c*. The primary charging device 2 is also provided with a shutter position sensor 2*f*. The shutter opening movement of the shutter driving device 2*b* is detectible because of the contact between the shutter position sensor 2*f* and shutter driving device 2*b*. The shutter position sensor 2*f* is in connection with the controller 51 as the controlling means. The controller 51 is provided with the shutter detecting means 51*a* for detecting a shutter position signal outputted by the shutter position sensor 2*f*. The controller 51 drives the photosensitive drum 1 and charging device shutter 10 in the period between the end of an image forming operation (end of the formation of the last image) and the beginning of the next image forming operation. To describe in more detail, after the removal of the residual toner on the peripheral surface of the photosensitive drum 1 by the cleaning blade 7*a*, which rubs the peripheral surface of the photosensitive drum 1 as the photosensitive drum 1, rotates, the primary charging device 2, transfer charging device 5, and separation charging device 6 are shielded from the photosensitive drum 1 by the driving of the charging device shutter 10 into the space between the photosensitive drum 1 and primary charging device 2, space between the photosensitive drum 1 and transfer charging device 5, and space between the photosensitive drum 1 and separation charging device 6. The abovementioned "end of an image forming operation" means the end of the cleaning operation carried out by the cleaning means 7 to clean the peripheral surface of the photosensitive drum 1 while rotating the photosensitive drum 1, immediately after the end of an image forming operation. It is also possible to literally interpret the "end of an image forming operation" as the actual end of an image forming operation.

The charging device shutter 10 is in the form of a sheet, one end of which is attached to the shutter driving device 2*b*. The charging device shutter 10 is structured so that during an image forming operation, it remains retracted by being rolled up on the front side of the primary charging device 2 in terms of the primary scanning direction. The charging device shutter 10, which is a shielding member, is enabled to keep the photosensitive drum 1 shielded from the primary charging device 2 during the period from the completion of an image forming operation (completion of last image), and the restarting of the image forming operation.

Further, the charging device shutter 10, which is positioned between the transfer charging device 5 and photosensitive drum 1, and between the separation charging device 6 and photosensitive drum 1, is structured the same as the above described charging device shutter 10, which is positioned between the primary charging device 2 and photosensitive drum 1. That is, the image forming apparatus is structured so that the charging device shutter 10, which is a shielding member, can shield the photosensitive drum 1 from the transfer charging device 5 and separation charging device 6. The charging device shutter 10 is for preventing the byproducts of corona discharge (which hereafter may be referred to simply as discharge byproducts), from falling onto the photosensitive drum 1. Thus, the charging device shutter 10 is formed of a substance which is chemically stable in that even if it comes into contact with the photosensitive drum 1, its ingredients do not adhere to the peripheral surface of the photosensitive drum 1. Further, it is desired to be formed of a substance which can be rolled up after being formed into the charging device shutter 10. In this embodiment, a piece of 30 μm thick polyimide film was used as the material for the charging device shutter 10. The opening or closing of the charging device shutter 10 is started as soon as the rotation of the photosensitive drum 1 stops at the end of an image forming operation.

FIG. 2 shows the structure of the charging device shutter 10. FIG. 2(*b*) is a sectional view of the charging device shutter 10, and FIG. 2(*c*) is a perspective view of the charging device shutter 10. Referring to FIGS. 2(*b*) and 2(*c*), one end of the charging device shutter 10 is in connection with a shutter conveying member 2*d* of the shutter driving device 2*b*, which is arcuate in cross section. The shutter conveying member 2*d* is for guiding the charging device shutter 10 into the narrow gap, which is arcuate in cross section, while preventing the charging device shutter 10 from hanging up in the gap. The shutter conveying member 2*d* may be formed of a thin sheet of metal. The shutter driving device 2*b* is in connection with a rotating member 2*c*. The rotating member 2*c* has a spiral groove. Thus, as the rotational member 2*c* is rotated by an unshown motor, a connecting member 2*g*, which is in engagement with the spiral groove of the rotational member 2*c*, is moved rearward following the spiral groove. The image forming apparatus 50 is structured so that the charging device shutter 10 is inserted into the space between the primary charging device 2 and photosensitive drum 1 in synchronism with the rearward movement of the shutter driving device 2*b* in terms of the primary scan direction of the primary charging device 2. The shape of the charging device shutter 10 is controlled by the shape of the shutter conveying member 2*d*. Thus, as the charging device shutter 10 is inserted between the space between the primary charging device 2 and photosensitive drum 1, it is changed in shape so that its shape matches the bottom end of the primary charging device 2. Further, in order to keep the charging device shutter 10 in such a state that makes it difficult for the discharge byproducts from leaking through the gap between the charging device shutter 10 and primary charging device 2, the image forming apparatus 50 is desired to be structured so that the charging device shutter 10 remains under a certain amount of tension when it is opened or closed while remaining in the shape which matches the bottom end of the primary charging device 2.

At this time, referring to FIG. 2(*a*), the shutter position sensor 2*f*, which is for detecting whether or not the charging device shutter 10 is in the completely retracted state (opening operation), will be described. Referring to FIG. 2(*a*), the primary charging device 2 is provided with the shutter position sensor 2*f* for detecting the arrival of the shutter driving device 2*b* to check whether or not the opening movement of the charging device shutter 10 is completed. The shutter position sensor 2*f* is on the retracting side of the charging device shutter 10. Further, the charging device shutter 10, which is moved into the space between the transfer charging device 5 and photosensitive drum 1, and the space between the separation charging device 6 and photosensitive drum 1, is also provided with a shutter position sensor 2*f* (second shutter position sensor) as is the abovementioned shutter position sensor 2*f* (first shutter position sensor). The second shutter position sensor 2*f* is the same in operation as the first one. In this embodiment, the shutter for closing the opening of the charging device of the corona type exposes or covers the opening by moving in the direction parallel to the rotational axis of the photosensitive drum 1. The length of time necessary for the leading edge of the shutter to move from the position in which the edge is during the formation of an image, to the position in which the edge will be after the complete covering of the opening of the charging device of the corona type is 12 seconds.

3. Low Power Mode

The image forming apparatus 50 has a "low power mode", that is, a standby mode, which is lower in electric power consumption than the "image formation mode" (in which images are actually formed by image forming apparatus 50). The image forming apparatus 50 in this embodiment has two "low power modes". One is a low electric power consumption mode (first mode which is lower in electric power consumption, and the second one is a no electric power consumption mode (second mode) in which no electric power is consumed. In the low electric power consumption mode (so-called standby mode), the controller 51 controls the image forming apparatus 50 in such a manner that an image is formed as soon as an image formation signal is inputted. In this mode, the amount by which electric power is consumed is reduced by lowering the fixing device in temperature, and/or stopping rotating the photosensitive drum 1, for example. By comparison, when the image forming apparatus 50 is in the no electric power consumption mode (so-called sleep mode), the image forming apparatus 50 is kept "asleep" by stopping the electric power to the fixing device, etc. However, even if the image forming apparatus 50 is in the no electric power consumption mode, a minute amount of electrical power, that is, no larger than 100 mW, may be consumed to keep internal timer, etc., active.

After the completion of an image forming operation, the image forming apparatus 50 switches from the image formation mode to the low electric power consumption mode (standby mode). If no image formation signal is inputted within a preset length of time while the image forming apparatus 50 is in the low electric power consumption mode, the image forming apparatus 50 switches from the low electric power consumption mode to the no electric power consumption mode (sleep mode). The image forming apparatus 50 is provided with a soft switch. Thus, a user can instantly put the image forming apparatus 50 in the no electric power consumption mode by pushing the switch, even if the preset length of time has not elapsed.

That is, between the end of an image forming operation to the beginning of the next image forming operation, the image forming apparatus 50 switches from the image formation mode to one of the above described two low electric power consumption modes (standby mode, or sleep mode). Further, the overall operation of the image forming apparatus 50 includes the pre-rotation period (process), which is to be carried out immediately before the starting of an image forming operation, and in which the photosensitive drum 1 is rotated without forming an image, in order to adjust the image forming apparatus 50 in terms of various image formation requirements. The overall operation of the image forming apparatus 50 also includes a post-rotation period (process), which is to be carried out after the completion of an image forming operation. The post-rotation period (process) is for removing the toner remaining on the peripheral surface of the photosensitive drum 1, with the cleaning blade 7*a*. After the end of the post-rotation period, the image forming apparatus 50 switches to the low electric power consumption mode. In this embodiment, when the low electric power consumption mode is switched to the sleep mode, the shutter, as the shielding member, shields the photosensitive member from the opening of the charging device, which faces the photosensitive drum 1. When the shutter is operated to shield the photosensitive drum 1 from the opening of the charging device of the corona type, the photosensitive drum 1, which is kept stationary in the low electric power consumption mode, is rotated again to remove the byproducts of electrical discharge having adhered on the peripheral surface of the photosensitive drum 1, by the cleaning blade 7*a*.

Further, a "period from the end of an image forming operation, to the beginning of the shielding of the photosensitive drum 1 from the primary charging device 2, transfer charging device 5, and separation charging device 6 by the charging device shutter 10", and a "period from the end of an image forming operation, to the starting of the low electric power consumption mode", may be set by the setting means 51*d*. Further, the image forming apparatus 50 may be structured so that the abovementioned "periods" can be modified by the setting means 51*d* in response to the inputs from a user.

It is possible that the period from the end of an image forming operation to the beginning of the shielding of the photosensitive drum 1 from the primary charging device 2, transfer charging device 5, and separation charging device 6 by the charging device shutter 10 will be shorter than the period from the end of the image forming operation to the starting of the low electric power consumption mode (sleep mode). To describe more concretely, it is assumed that the default timing (for example, four hours from end of image forming operation) for placing the image forming apparatus 50 in the sleep mode is earlier (for example, one hour) than the shutter closing timing selected by a user. In a case such as this, the shutter is closed one hour after the timing selected by the user, and the photosensitive drum 1, which was not rotating after the completion of an image forming operation is idly rotated again to rub the peripheral surface of the photosensitive drum 1 with the cleaning blade 7*a*, which is in contact with the peripheral surface of the photosensitive drum 1 to rub the peripheral surface of the photosensitive drum 1.

In comparison, it is assumed that the length of time (for example, five hours) selected by a user as the length of time from the end of an image forming operation to the starting of the shielding operation is longer than the length of time (for example, four hours) from the end of the image forming operation to the transition to the low electric power mode (sleep mode). In this case, the image forming apparatus 50 is controlled so that the rubbing by the cleaning blade 7*a* does not occur.

As the soft switch is pressed, or a signal from the timer is inputted, the image forming apparatus 50 carries out the preparatory operation for placing the main assembly of the image forming apparatus 50 in the sleep mode, and then, switches to the no electric power consumption mode (sleep mode) in which no electric power is consumed. The preparatory operation for switching to the sleep mode includes the shielding of the photosensitive drum 1 from the opening of the primary charging device 2, opening of the transfer charging device 5, and opening of the separation charging device 6) by the charging device shutter 10, and the removal of the byproducts of electrical discharge, which might have accumulated on the peripheral surface of the photosensitive drum 1, by the cleaning device 7. The image forming apparatus 50 is placed in the no electric power consumption mode (sleep mode) after the preparatory operations described above. Therefore, even when the image forming apparatus 50 is used after it was left unused for a long time, the electrical charge given to the peripheral surface of the photosensitive drum 1 to form an image is not drained by a significant amount.

4. Operation for Removing Byproducts of Electrical Discharge on Photosensitive Member Described next is the operation carried out to remove the byproducts of electrical discharge on the peripheral surface of the photosensitive drum 1, when closing the charging device shutter 10. The image forming apparatus 50 in this embodiment is idly rotated for five minutes immediately before the charging device shutter 10 is closed. During this idling of the photosensitive drum 1, the byproducts of electrical discharge having accumulated on the peripheral surface of the photosensitive drum 1 can be removed by the cleaning blade 7*a*, which is placed in contact with the peripheral surface of the photosensitive drum 1 to remove the byproducts. The rotation of the photosensitive drum 1, which is caused when closing the charging device shutter 10, is for re-rotating the photosensitive drum 1 to remove the byproducts of electrical discharge, after its rotation is stopped after the completion of an image forming operation. Incidentally, the timing with which the photosensitive drum is rotated again for five minutes to remove the byproducts of electrical discharge on the peripheral surface of the photosensitive drum may be after the closing of the charging device shutter 10. The operation carried out by the cleaning blade 7*a*, which is a "removing member" and a "cleaning member", during the idly rotation of the photosensitive drum 1, is the same as that carried out during an image forming operation proper. Therefore, the cleaning blade 7*a* may be simple in structure; the peripheral surface of the photosensitive drum 1 is cleaned by simply rotating the photosensitive drum 1. Further, the peripheral surface of the photosensitive drum 1 may be supplied with polishing particles during the operation for removing the byproducts of electrical discharge. Further, the efficiency with which the byproducts of electrical discharge are removed by the cleaning blade 7*a* can be improved by supplying the peripheral surface of the photosensitive drum 1 with developer. Thus, during the operation for removing the byproducts of electrical discharge, the peripheral surface of the photosensitive drum 1 may be supplied with developer. Further, the byproducts of electrical discharge may be removed by a polishing roller, as a removing member, which is disposed in such a manner that it can be placed in contact with, or separated from, the peripheral surface of the photosensitive drum 1. Further, the above described structural and operational arrangements may be used in combination to remove the byproducts of electrical discharge. In consideration of the productivity of the image forming apparatus 50 immediately after its startup, the operation (for removing byproducts of electrical discharge) in which the photosensitive drum 1 is idly rotated to be cleaned is carried out immediately before the image forming apparatus 50 is placed in the no electric power consumption mode (sleep mode).

5. Image Forming Apparatus Operation Based on Flowchart

Figure 3:
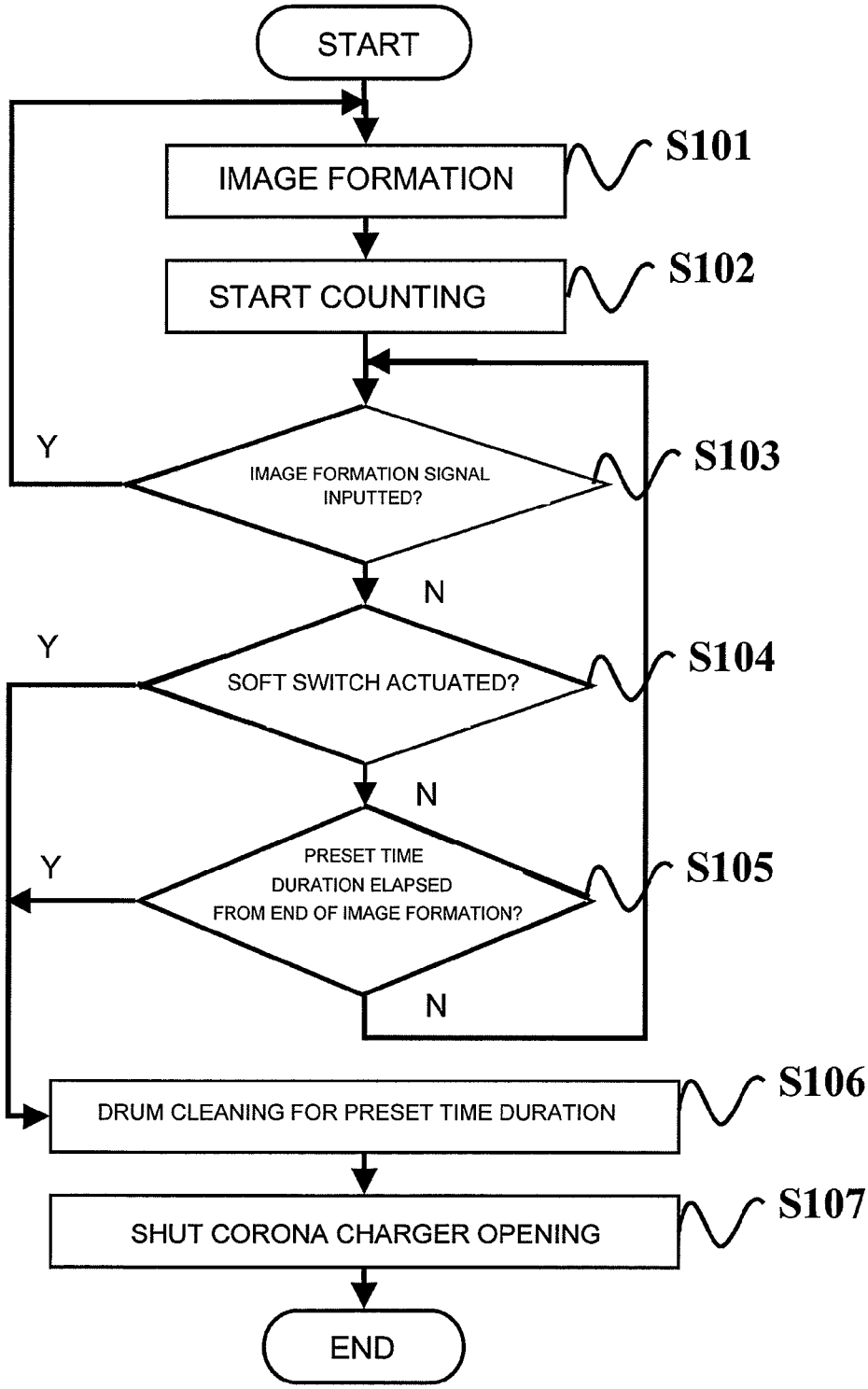
FIG. 3 is a flowchart of the control sequence for the shutter.

Hereafter, the operation of the image forming apparatus 50 will be described using a flowchart. FIG. 3 is a flowchart which shows the shutter control sequence. The controller 51, that is, a controlling means, controls the image forming apparatus 50 by carrying out the program stored in a memory (unshown). In this embodiment, in order to prevent the photosensitive drum 1 from being damaged by the contact between the charging device shutter 10 and photosensitive drum 1, and also, to prevent the charging device shutter 10 from being wound up by the contact between the charging device shutter 10 and photosensitive drum 1, the operation for cleaning the photosensitive drum 1 by rotating the photosensitive drum 1 is carried out immediately before the starting of the shielding operation by the charging device shutter 10. In the case of an image forming apparatus structured so that there is a substantial amount of distance between the charging device shutter 10 and the photosensitive drum 1, the operation for cleaning the photosensitive drum 1 by rotating the photosensitive drum 1 may be carried out immediately before, during, or immediately after the shielding operation of the charging device shutter 10.

Step S101 in FIG. 3 is the step for forming an image on a sheet of recording medium. The controller 51 makes the image forming apparatus 50 form an image in response to an inputted image formation signal. After the formation of the image in response to the inputted image formation signal, the controller 51 begins to measure the length of time which elapses since the end of the image formation, using a counter as a measuring means (S102). The length of time from the end of the image forming operation, which is measured by the counter is the length of time from the completion of the last image by the image forming apparatus 50. That is, the counter measures the length of time from the end of the formation of the last image to the time when the next image formation signal is inputted while the image forming apparatus 50 is kept on standby (S103-S105).

In Steps S103-S105, the controller 51 keeps the image forming apparatus 50 on standby mode (above described low electric power consumption mode) so that the image forming apparatus 50 can immediately form an image in response to inputting of the next image formation signal. Further, the controller 51 carries out Steps S103-S105 for a preset length of time, or until the image forming apparatus 50 is placed in the sleep mode (no electric power consumption mode) by the operation of the soft switch by a user.

Step S103 is the step in which whether or not an image formation signal has just been inputted is checked to determine whether or not the image forming apparatus 50 is to start forming an image. If the controller 51 determines that an image formation signal has just been inputted, it makes the image forming apparatus 50 carry out Step S101, that is, the image formation step, in response to the inputted image formation signal.

Step S104 is the transitional step between the standby mode and sleep mode. That is, it is the step for checking whether or not a user has operated the soft switch. If the controller 51 determines in Step S104 that the soft switch has just been operated by the user, the controller 51 carries out Step S106 (switch to sleep mode). If the controller 51 determines that the soft switch has not just been pressed, it carries out Step S105 (keeps image forming apparatus 50 on standby).

Step S105 is the step for checking whether or not a preset length of time has elapsed after the ending of the formation of the last image. If it is determined in Step S105 that the preset length of time has elapsed, the controller 51 takes the image forming apparatus 50 out of the standby mode. If the length of time which begins to be measured by the counter after the completion of the last image becomes longer than the preset length (if value in counter is greater than preset value), the controller 51 makes the image forming apparatus 50 go through Step S106 (switch to sleep mode). On the other hand, if it is determined by the counter in Step S105 that the preset length of time has not elapsed after the formation of the last image, the controller 51 makes the image forming apparatus 50 to go through Step S103 (continuation of standby mode). In the standby mode, the controller 51 reduces the electrical power consumption of the image forming apparatus 50, by keeping the temperature of the fixing device lower than the temperature level at which the temperature of the fixing apparatus is maintained during an image forming operation (low electric power consumption mode).

Steps S106 and S107 are the steps for carrying out the preparatory operation, which is to be carried out to takes the image forming apparatus 50 out of the standby mode, and place it in the sleep mode. The controller 51 controls the image forming apparatus 50 in such a manner that the photosensitive drum 1 is rotated again, which was kept stationary after being stopped after the completion of the post-rotation step, in order to remove the byproducts of electrical discharge having accumulated on the peripheral surface of the photosensitive drum 1. In Step S106, the controller 51 makes the photosensitive drum 1 idly rotate for the length of time (five minutes in this embodiment) set by the setting means 51*d*. Then, the controller 51 controls the image forming apparatus 50 so that the charging device shutter 10 shields the photosensitive drum 1 from the opening of the charging device 2 (S107). After the closing of the charging device shutter 10, the image forming apparatus 50 switches into the sleep mode.

If an image formation signal is inputted while the charging device shutter 10 is remaining closed, the controller 51 begins the operation for opening the charging device shutter 10. As soon as the shutter position sensor 2*f* detects that the charging device shutter 10 has been completely retracted (charging device shutter 10 is in completely open state), the image forming apparatus 50 is placed in the standby mode, in which the image forming apparatus 50 can form an image any time.

As described above, after the completion of the last image, the cleaning means activating means 51*c* of the image forming apparatus 50 begins rotating the photosensitive drum 1 to rub the peripheral surface of the photosensitive drum 1 by the cleaning device 7, before the starting of the closing of the charging device shutter 10. Therefore, the byproducts of electrical discharge on the peripheral surface of the photosensitive drum 1 begin to be reduced by the rubbing operation of the cleaning device 7. Therefore, the phenomenon that the byproducts of electrical discharge which were generated during image formation and adhered to the primary charging device 2, transfer charging device 5, and separation charging device 6, adhere to the peripheral surface of the photosensitive drum 1 while the image forming apparatus 50 is in the sleep mode does not occur. Further, the phenomenon that the peripheral surface of the photosensitive drum 1 reduces in electrical resistance because the byproducts of electrical discharge having adhered to the peripheral surface of the photosensitive drum 1 absorb moisture, does not occur. Therefore, even if the image forming apparatus 50 is left unused for a long time, the electrical charge given to the peripheral surface of the photosensitive drum is not drained by a significant amount, and therefore, excellent images are formed.

Embodiment 2

The image forming apparatus in the second preferred embodiment is the same in structure, including the features listed below, as the image forming apparatus 50 in the first preferred embodiment. That is, when the image forming apparatus switches from the standby mode to the sleep mode because the soft switch is pressed, or the preset length of time has elapsed, the photosensitive drum 1 is shielded from the opening of the primary charging device 2 by the shielding operation of the charging device shutter 10. Further, in order to remove the byproducts of electrical discharge on the peripheral surface of the photosensitive drum 1, by the cleaning device 7, before shielding the photosensitive drum 1 by the charging device shutter 10, the rotation of the photosensitive drum 1 is restarted immediately before the charging device shutter 10 begins to shield the photosensitive drum 1. Therefore, even if the image forming apparatus 50 is left unused thereafter for a long time in a highly humid environment, it does not occur that the electrical charge given to the peripheral surface of the photosensitive drum is drained by a significant amount.

On the other hand, the image forming apparatus in the second preferred embodiment is different in the following structural features from the image forming apparatus 50 in the first preferred embodiment. That is, in the case of the image forming apparatus in this embodiment, the period in which the toner on the peripheral surface of the photosensitive drum 1 is removed by the cleaning blade 7*a* is modifiable in length based on the length of the "period from the end of the formation of the last image to the starting of the low electric power consumption mode", or the "period from the end of the formation of the last image to the starting of the shielding of the photosensitive drum". Further, the period in which the toner on the peripheral surface of the photosensitive drum 1 is removed by the cleaning blade 7*a* is also modifiable in length based on the "cumulative number of sheets of recording medium on which an image was formed".

To describe simply, in this embodiment, the length of time the photosensitive drum 1 is rotated for the purpose of cleaning the photosensitive drum 1 is changed based on the "length of time the image forming apparatus 50 is kept in the sleep mode", or the "cumulative number of prints outputted by the image forming apparatus". Therefore, in a case where the image forming apparatus is kept in the sleep mode for a long time, or the cumulative number of the prints outputted by the image forming apparatus 50 is large, the length of time for cleaning the photosensitive drum 1 is set longer accordingly. On the other hand, in a case where the image forming apparatus is kept in the sleep mode is relatively short, or the cumulative number of the prints outputted by the image forming apparatus is relatively small, the length of time for cleaning the photosensitive drum 1 is set relatively short. The above described control executed by the controller 51 can significantly reduce the amount by which the photosensitive drum 1 and cleaning blade 7*a* wear.

Incidentally, the cumulative number of the prints outputted by the image forming apparatus, and the length of time the image forming apparatus is kept in the sleep mode, are stored in the internal nonvolatile memory (unshown), as a storage means, of the controller 51. Further, the controller 51, which also functions as an information obtaining means, obtains the "cumulative number of the prints", "length of time the image forming apparatus was kept in the sleep mode" etc., and then, uses the obtained information to change the length of time the photosensitive drum 1 is idly rotated when the shutter is closed.

In consideration of the productivity, etc., of the image forming apparatus immediately after the startup of the image forming apparatus, this operation for cleaning the photosensitive drum 1 by rotating the photosensitive drum 1 without forming an image is carried out immediately before the image forming apparatus is put in the sleep mode after the elapse of the aforementioned preset length of time, or before the image forming apparatus is put in the sleep mode by turning off the soft switch. By the way, the operation for cleaning the photosensitive drum 1 by rotating the photosensitive drum 1 without forming an image may be carried out during the transition from an image forming mode to the sleep mode, or during the transition from the standby mode to the sleep mode caused by the pressing of the soft switch. Further, it may be carried out when the image forming apparatus is started up next time. In order to prevent the photosensitive drum 1 and charging device shutter 10 from being damaged by the contact between the charging device shutter 10 and photosensitive drum 1, and/or prevent the charging device shutter 10 from being wrapped up around the photosensitive drum 1, this operation for cleaning the photosensitive drum 1 by rotating the photosensitive drum 1 without forming an image is carried out immediately before the shielding operation by the charging device shutter 10 is started. Further, the timing with which this operation for cleaning the photosensitive drum 1 by rotating the photosensitive drum 1 without forming an image is to be carried out may be immediately before the shielding operation by the charging device shutter 10 is started, during the shielding operation, or after the shielding operation.

As described above, the length of time the cleaning blade 7*a* removes the toner on the peripheral surface of the photosensitive drum 1 is changeable based on the "length of time from the end of the formation of the last image to the starting of the low electric power consumption mode", or the "length of time from the end of the formation of the last image to the starting of the shielding operation". The length and timing of the toner removing period is changeable by the above described altering means 51*e*. The length of time the photosensitive drum is rotated for the purpose of cleaning the photosensitive drum 1 is changed based on the length of time the image forming apparatus is kept in the sleep mode, and the cumulative number of the prints outputted by the image forming apparatus. The method for determining the length of time the photosensitive drum 1 is to be rotated during the operation of the charging device shutter 10 will be shown next.

Figure 4:
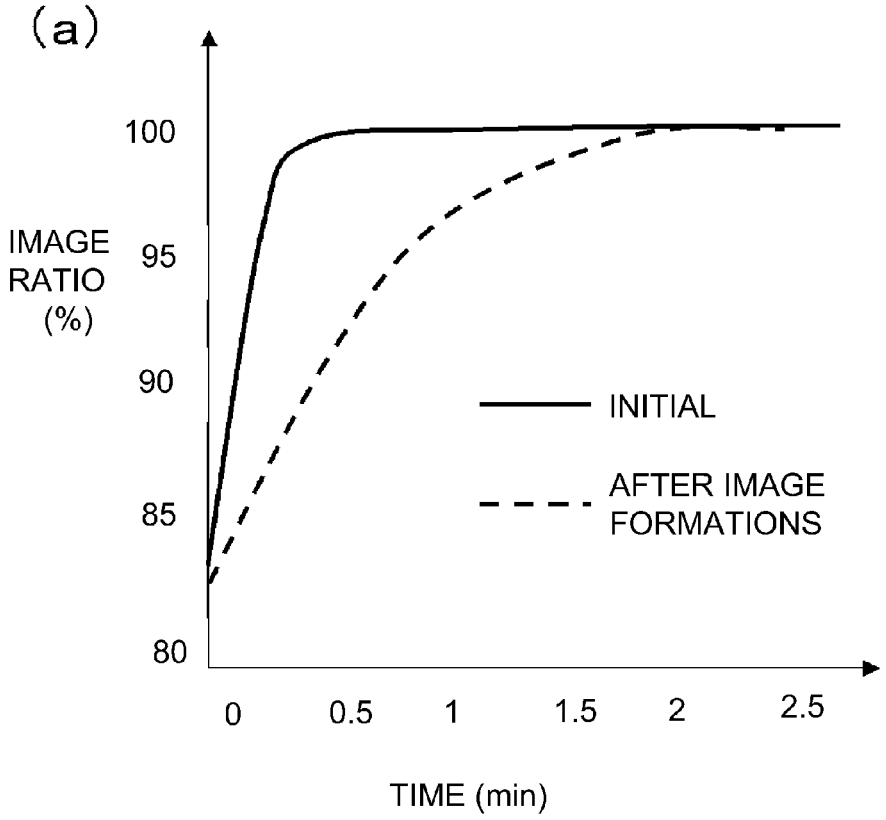
FIG. 4 is a graph which shows the relationship among the cumulative number of the prints outputted by the image forming apparatus, extent of deterioration of image forming apparatus in terms of charge drain, and length of recovery time, in one of the preferred embodiments of the present invention.
Figure 4:
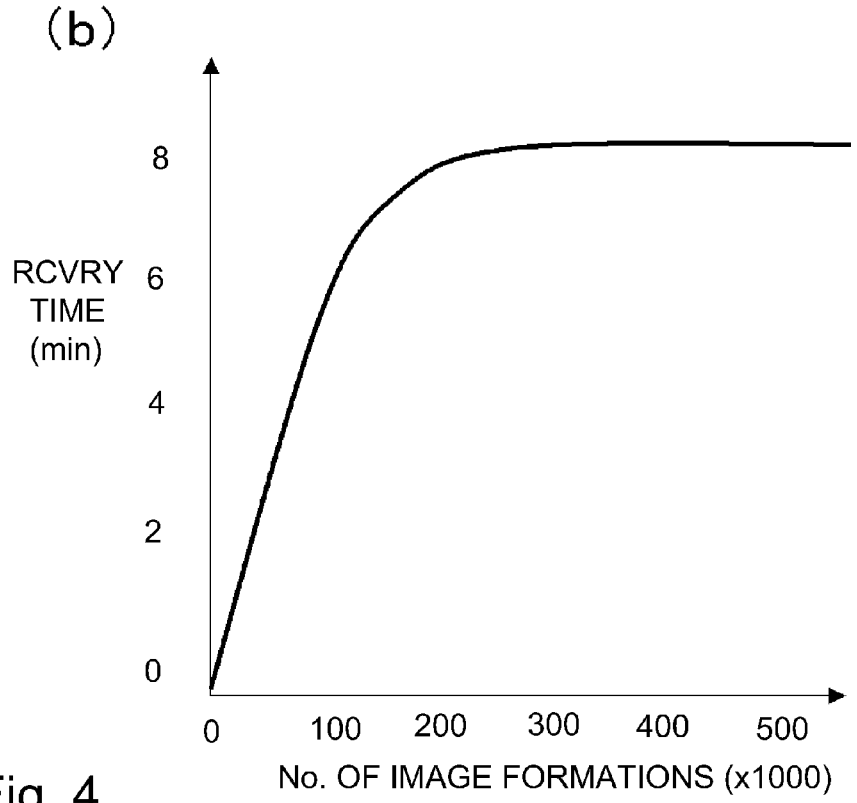

FIG. 4 shows the relationships among the deterioration of the peripheral surface of the photosensitive drum in terms of the draining of electrical charge therefrom, cumulative number of prints outputted by the image forming apparatus, and length of time necessary for recovery. As will be evident from FIGS. 4(*a*) and 4(*b*), when the cumulative number of the outputted prints is relatively small, the amount of the byproducts of electrical discharge having accumulated by the primary charging device 2 (transfer charging device 5, and separation charging device 6) are relatively small. Therefore, the length of time to be spent for the cleaning operation may be shorter even if there is the period in which the image forming apparatus is kept in the sleep mode. Next, these relationships will be described referring to an example.

TABLE 1

| Rest period | No. of Processed sheets (×1000) | | | | |
|---|---|---|---|---|---|
| (hr) | 0-50 | 50-100 | 100-200 | 200-500 | >500 |
| 0-0.5 | 0 sec | 0 sec | 15 sec | 15 sec | 30 sec |
| 0.5-1 | 0 sec | 15 sec | 15 sec | 30 sec | 30 sec |
| 1-3 | 15 sec | 15 sec | 30 sec | 30 sec | 1 min |
| 3-8 | 15 sec | 30 sec | 1 min | 3 min | 3 min |
| >8 | 30 sec | 1 min | 3 min | 5 min | 5 min |

Table 1 is a table which shows the relationships among the "cumulative number of the outputted prints", "length of time the image forming apparatus was kept in the sleep mode", and "length of cleaning time". As will be evident from Table 1, the length of cleaning time is set based on the "cumulative number of the outputted prints", and "length of time the image forming apparatus is kept in the sleep mode". The expressions "0-49,999 prints, 50,000-99,999 prints, 100,000-199,999 prints, and 200,000-499,999 prints, and 500,000-" in the first row of the table means that the cumulative number of the outputted prints means "0≦cumulative number of outputted prints<50,000, 50,000≦cumulative number of outputted print<100,000, 100,000≦cumulative number of outputted print<200,000, 200,000≦cumulative number of outputted print<500,000, and 500,000≦cumulative number of outputted print", respectively. Further, the expressions 0-0.5H, 0.5-1H, 1-3H, 3-8H, and 8H—in the first column of the table means "0≦in active time<0.5H, 0.5≦inactive time<1H, 1H≦inactive time<3H, 3H inactive time<8H, and 8H inactive time", respectively. In a case where the cumulative number of the outputted prints is in a range of 0-49,999, or 50,000-99,999, and the length of time the image forming apparatus is kept in the sleep mode is in a range of 0-0.5H, the length of the cleaning time is 0 second. In a case where the cumulative number of the outputted prints is in a range of 0-49,999, and the length of time the image forming apparatus is kept in the sleep mode is in a range of 0.5H-1H, the length of the cleaning time is 0 second.

In the first preferred embodiment, the length of the cleaning time was always the same at 5 minutes. In this embodiment, however, the controller 51, which also functions as an information obtaining means, controls the image forming apparatus in such a manner that the photosensitive drum 1 is cleaned for one of the lengths of time in Table 1, which is selected based on the cumulative number of the outputted prints, and the length of time the image forming apparatus is kept in the sleep mode, which are stored in the nonvolatile memory. That is, the length of time the photosensitive drum 1 is to be cleaned in Step S106 in FIG. 3 is determined based on the above-described table (Table 1). Incidentally, the relationships in Table 1 are stored, as a table, in the nonvolatile memory which is a storage means.

As described above, the cleaning means activating means 51*c* of the image forming apparatus in the second preferred embodiment makes the cleaning device 7 rub the peripheral surface of the photosensitive drum 1 by beginning to rotate photosensitive drum 1 before starting to close the charging device shutter 10. Therefore, before the charging device shutter 10 begins to shield the photosensitive drum 1 from the opening of the primary charging device 2, opening of the transfer charging device 5, and opening of the separation charging device 6, the byproduct of electrical discharge on the peripheral surface of the photosensitive drum 1 begins to be reduced by the rubbing of the photosensitive drum 1 by the cleaning device 7. Therefore, the phenomenon that the byproducts of electrical discharge, which were generated during an image forming operation, and adhered to the primary charging device 2, transfer charging device 5, and separation charging device 6, adhere to the peripheral surface of the photosensitive drum 1 while the image forming apparatus is in the sleep mode, is prevented from occurring. Further, the phenomenon that the peripheral surface of the photosensitive drum 1 reduces in electrical resistance because of the absorption of moisture by the byproducts of electrical discharge is also prevented from occurring. Therefore, even if the image forming apparatus is left unused for a substantial length of time, the draining of electrical charge by a significant amount is prevented, and therefore, excellent images are formed.

In this embodiment, the length of time the photosensitive drum 1 is cleaned is set based on the cumulative number of the prints outputted by the image forming apparatus. Thus, the cumulative number of the outputted print may be reset when the photosensitive drum 1 is replaced, when the cleaning blade 7*a*, as a cleaning member, is replaced, or when the charging device of the corona type, is replaced. Further, the amount by which the byproducts of electrical discharge adhere to the photosensitive drum 1 in an image forming apparatus is affected by the number of prints which are continuously outputted in the image forming operation. Therefore, the length of time the photosensitive drum 1 is cleaned during the closing of the charging device shutter 10 may be adjusted based on the number of the prints outputted in the immediately preceding job.

Embodiment 3

The image forming apparatus in the third preferred embodiment is roughly the same in structure, including the following features, as the image forming apparatus in the first preferred embodiment. That is, as a preset length of time elapses after the end of the formation of the last image, the photosensitive drum 1 is shielded by the charging device shutter 10 from the opening of the primary charging device 2. Further, immediately before the shielding operation of the charging device shutter 10 is started, the photosensitive drum 1 is rotated without forming an image to remove the byproducts of electrical discharge having accumulated on the peripheral surface of the photosensitive drum 1 up to this point, by the cleaning device 7. With the removal of the byproducts of electrical discharge from the peripheral surface of the photosensitive drum 1, the draining of electrical charge by a significant amount does not occur even if the image forming apparatus is left for a substantial length of time in an environment in which the byproducts of electrical discharge could absorb moisture.

On the other hand, the image forming apparatus in this embodiment is different in the following structural features from the image forming apparatus 50 in the first preferred embodiment. That is, in the case of the image forming apparatus in the third preferred embodiment, the "period from the end of the formation of the last image to the starting of the low electric power consumption mode" is adjustable based on the cumulative number of the sheets of recording medium on which an image was formed, and the absolute amount of moisture in the air in the main assembly of the image forming apparatus. Further, the "period from the end of the formation of the last image to the starting of the low electric power consumption mode", is also adjustable based on the length of toner removal time, that is, the length of time the cleaning blade 7*a* removes the toner on the peripheral surface of the photosensitive drum 1.

The "period from the end of the formation of the last image to the starting of the shielding of the photosensitive drum 1 by the charging device shutter 10 from the primary charging device 2, transfer charging device 5, and separation charging device 6" is adjustable based on the cumulative number of the sheets of recording medium on which an image was formed, and the absolute amount of (moisture in the air in the main assembly of the image forming apparatus. The "period from the end of the formation of the last image to the starting of the shielding of the photosensitive drum 1 from the primary charging device 2, transfer charging device 5, and separation charging device 6 by the charging device shutter 10" is changeable in length based on the length of time the toner on the peripheral surface of the photosensitive drum 1 is removed by the cleaning blade 7*a*. The above described "period from the end of the formation of the last image to the starting of the low electric power mode", or "period from the end of the formation of the last image to the starting of the shielding of the photosensitive drum 1 from the primary charging device 2, transfer charging device 5, and separating charging device 6 by the charging device shutter 10", can be set by the above described setting means 51*d*.

Figure 5:
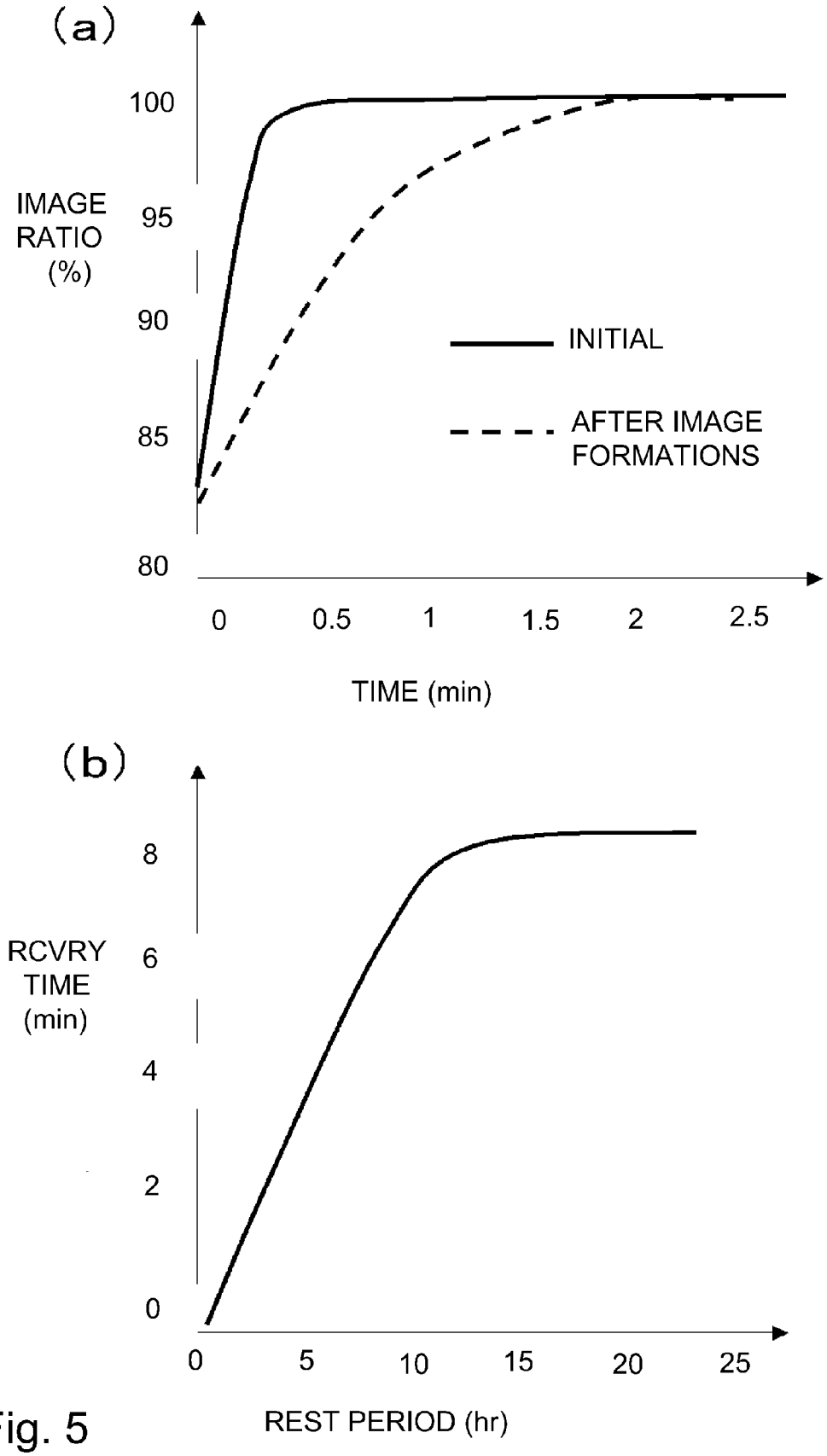
FIG. 5 is a graph which shows the relationship among the cumulative number of the prints outputted by the image forming apparatus, extent of deterioration of image forming apparatus in terms of charge drain, and length of recovery time, in another embodiment of the present invention.

For example, the length of time the image forming apparatus is kept in the sleep mode after the photosensitive drum is cleaned for a preset length of time, the length of time the image forming apparatus is kept in the sleep mode from the formation of the last image to the starting of the shielding operation by the charging device shutter 10, is changed based on the cumulative number of the prints formed up to the current cleaning time. Thus, in a case where the cumulative number of prints is relatively large, the length of time the image forming apparatus is to be kept in the sleep mode is set relatively short, whereas in a case where the cumulative number of prints is relatively small, the length of time the image forming apparatus is to be kept in the sleep mode is set relatively long. The timing with which the operation for cleaning the photosensitive drum 1 by rotating the photosensitive drum 1 without forming an image is carried out may be during the shielding operation by the charging device shutter 10, or prior to the starting of the next image forming operation. In this embodiment, however, in consideration of productivity, etc., the operation for cleaning the photosensitive drum 1 is carried out immediately before the starting of the shielding operation by the charging device shutter 10. Next, one of the methods for setting a proper length of time for the period from the end of the formation of the last image to the starting of the shielding operation by the charging device shutter 10 will be described. FIG. 5 is a graph which shows the relationships among the degree of worsening of the draining of electrical charge from the peripheral surface of the photosensitive drum 1, the length of time the main assembly of the image forming apparatus is kept in the sleep mode, and the length of recovery time. FIG. 5(*a*) shows the changes in the degree worsening of the draining of electric charge, and FIG. 5(*b*) shows the changes in the recovery time. In a case where the cumulative number of the prints is relatively small, the amount by which the byproducts of electrical discharge is accumulated by the primary charging device 2 is relatively small, and therefore, the length of time the image forming apparatus is to be kept in the sleep mode may be set longer, which in turn makes it possible to reduce the number of times the charging device shutter 10 is to be operated.

TABLE 2

| | No. of processed sheets | | | |
|---|---|---|---|---|
| | 0-50 | 50-100 | 100-200 | >200 |
| Rest period | 8 hr | 5 hr | 3 hr | 1 hr |

Table 2 shows the relationship between the cumulative number of the prints outputted by the image forming apparatus, and the length of time (image forming apparatus is kept in the sleep mode) from the end of the formation of the last image to the starting of the shielding operation by the charging device shutter 10. The length a of time the image forming apparatus is to be kept in the sleep mode, that is, the length of time a from the end of the formation of the last image to the starting of the shielding by the charging device shutter 10, is set based on the cumulative number of the prints outputted by a given time, as shown in Table 2. That is, the length a of time the image forming apparatus is kept in the sleep mode is changed based on the cumulative number of the prints outputted by the image forming apparatus in this embodiment, according to Table 2. In order to control the image forming apparatus in the above-described manner, the controller 51, which also functions as an information obtaining means, obtains the cumulative number of the prints in the nonvolatile memory. Then, it changes the length of time which is allowed to elapse before the image forming apparatus is put in the sleep mode.

Next, referring to FIG. 3 which was described before, the operation of the image forming apparatus in the third preferred embodiment will be described. As soon as an image forming operation ends, the controller 51 sets the length a of time the image forming apparatus is kept in the sleep mode before the starting of the shielding by the charging device shutter 10, based on the cumulative print count. As the length a of time elapses after the end of the formation of the last image, the controller 51 rotates the photosensitive drum 1 for 30 seconds. In a case where the image forming apparatus is placed in the sleep mode by the soft switch before the length a of time elapses, the charging device shutter 10 is closed without carrying out the operation for cleaning the photosensitive drum 1. However, in the next case where the image forming apparatus is kept in the sleep mode while the charging device shutter 10 is kept open, the length a of time the image forming apparatus is kept in the sleep mode while the charging device shutter 10 is kept open, is accumulated. That is, as the cumulative length of time the image forming apparatus is kept in the sleep mode reaches the length a, the operation for cleaning the photosensitive drum 1 is carried out for 30 second immediately before the starting of the operation of the charging device shutter 10. In this embodiment, an electrostatic image, or a toner image, is not formed on the peripheral surface of the photosensitive drum 1 during the operation for cleaning the photosensitive drum 1. In other words, the peripheral surface of the photosensitive drum 1 is rubbed by the cleaning blade 7*a* by rotating the photosensitive drum 1 while sparing the electric power necessary to charge the photosensitive drum 1.

As soon as the cleaning of the photosensitive drum 1 ends, the shielding operation by the charging device shutter 10 is started. That is, it is checked by the shutter position sensor 2*f* whether or not the photosensitive drum 1 is shielded from the opening of the primary charging device 2 by the charging device shutter 10. If the photosensitive drum 1 is shielded, the image forming apparatus is placed in the sleep mode. Incidentally, if it is unnecessary to put the image forming apparatus in the sleep mode, and image forming apparatus is put in the standby mode. If the image forming apparatus in the sleep mode is made to start a recovery operation, or it is instructed to start a new job, the operation for opening the charging device shutter 10 is started. Then, as the shutter position sensor 2*f* detects that the photosensitive drum 1 is not shielded from the opening of the primary charging device 2, the image forming apparatus is placed in the standby mode, in which the image forming apparatus is ready for image formation. In the case of the image forming apparatus in the third preferred embodiment, the cleaning means activating means 51*c* causes the cleaning device 7 to rub the peripheral surface of the photosensitive drum 1, by beginning to rotate the photosensitive drum 1 before the charging device shutter 10 begins to close after the end of the formation of the last image. Therefore, the byproducts of electrical discharge on the peripheral surface of the photosensitive drum 1 is reduced by the photosensitive drum rubbing operation of the cleaning device 7, before the charging device shutter 10 begins to shield the photosensitive drum 1 from the opening of the primary charging device 2, the opening of the transfer charging device, and the opening of the separation charging device 6. Therefore, the phenomenon that while the image forming apparatus is in the sleep mode, the byproducts of electrical charge, which were generated during the immediately preceding image forming operation, and adhered to the primary charging device 2, transfer charging device 5, and separation charging device 6, adhere to the peripheral surface of the photosensitive drum 1, is prevented. Further, the phenomenon that the peripheral surface of the photosensitive drum 1 reduces in electrical resistance because of the absorption of the moisture by the byproducts of electrical discharge is also prevented from occurring. Therefore, even if the image forming apparatus is left unused for a substantial length of time, it does not occur that electrical charge drains from the charged portion of the peripheral surface of the photosensitive drum 1 by a significant amount after the charging of the peripheral surface of the photosensitive drum 1. Therefore, the image forming apparatus in this embodiment can form an excellent image even if it is left unused for a substantial length of time.

Embodiment 4

Also in this preferred embodiment of the present invention, the length of time the photosensitive drum 1 is rubbed by the cleaning blade is variable. If the length of time the photosensitive drum 1 is rubbed by the cleaning blade before the operational mode is switched to the sleep mode is excessively long, the length of the time the photosensitive drum 1 is rubbed by the cleaning blade is shortened by forming a toner belt (belt from of toner) on the peripheral surface of the photosensitive drum. Hereafter, the operation of the image forming apparatus in this embodiment will be described referring to a flowchart. Incidentally, in this preferred embodiment, the length of time the photosensitive drum is cleaned before shielding the photosensitive drum from the opening of the charging device of the corona type is selected from Table 1, which shows the relationships among the cumulative number of the prints outputted by the image forming apparatus, the length of time the image forming apparatus was not used, and the length of time the photosensitive drum is to be cleaned. If the peripheral surface of the photosensitive drum is charged by the charging device of the corona type to form a toner belt, the byproducts of electrical discharged are generated. Therefore, the toner belt is formed on the photosensitive drum 1 without charging the photosensitive drum 1, that is, by controlling the development bias.

Figure 6:
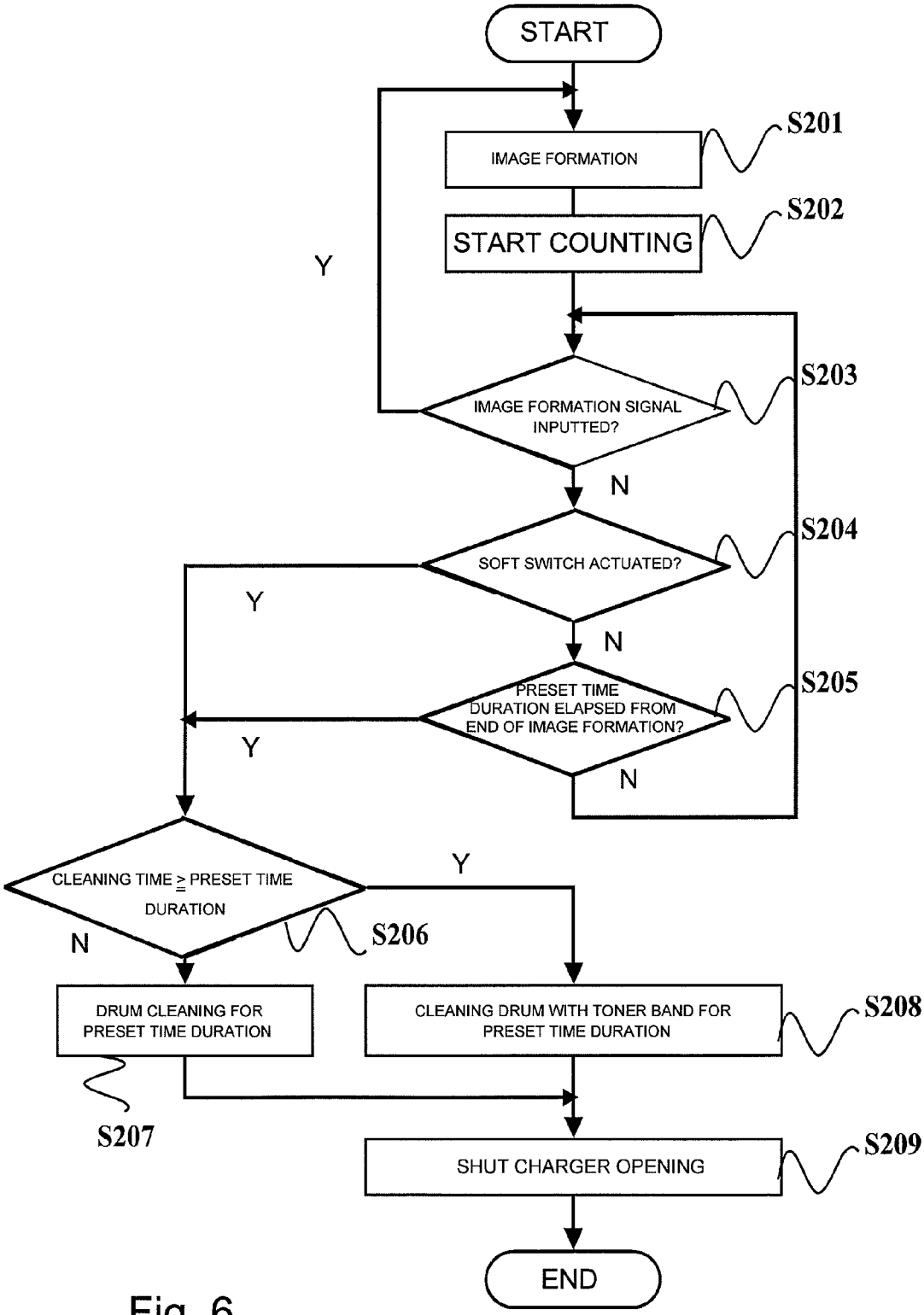
FIG. 6 is a flowchart of the control sequence for the shutter.

Next, the operation of the image forming apparatus, which is for forming a toner belt on the peripheral surface of the photosensitive drum 1 when the length of time necessary to clean the photosensitive drum 1 is longer than a preset value (which is one minute in this embodiment), will be described using a flowchart. FIG. 6 is the flowchart for describing this toner belt forming operation of the image forming apparatus. Steps S201-S205 are roughly the same as Steps S101-S105, and therefore, will not be described.

In Step S206, the controller checks whether or not the length of time the photosensitive drum is to be rotated for cleaning is longer than the preset length of time (one minute) from the relationships, such as those shown in Table 1, stored in the memory. If the length of time the photosensitive drum is to be rotated for cleaning is no more than the preset length of time (one minute), the controller carries out Step S207, whereas if the length of time the photosensitive drum is to be rotated for cleaning is no less than the preset length of time, the controller carries out Step S208.

Step S208 is the step which is to be carried out if the length of time the photosensitive drum 1 is to be rotated for cleaning is no less than one minute. In order to reduce the length of time the photosensitive drum is to be rotated for cleaning, the controller adjusts the development bias in such a manner that a toner belt is formed on the peripheral surface of the photosensitive drum. Consequently, the cleaning blade is supplied with toner, being thereby enabled to efficiently remove the byproducts of electrical discharge which is remaining adhered to the peripheral surface of the photosensitive drum. Therefore, the controller rotates the photosensitive drum for a shorter length of time than the cleaning length of time stored in the memory, to rub the peripheral surface of the photosensitive drum by the cleaning blade. In this embodiment, the length of time the photosensitive drum is rotated for cleaning is reduced by 30 seconds by supplying the cleaning blade with toner. For example, if the image forming apparatus is kept on standby for eight hours after it cumulatively outputted 100,000-200,000 prints, the controller 51 makes the image forming apparatus form a toner belt on the peripheral surface of the photosensitive drum, and rotates the photosensitive drum for two minutes and 30 seconds, which is 30 seconds shorter than three minutes. In other words, with this control, the length of time the photosensitive drum is to be rotated for cleaning before the image forming apparatus is put in the sleep mode can be significantly reduced.

In Step S209, the controller controls the image forming apparatus in such a manner that the opening of the charging device of the corona type is covered with the shutter. Incidentally, the operation for closing the shutter may be carried out at the same time as the operation for removing the byproducts of electrical discharge by rotating the photosensitive drum without forming an image is carried out.

Based on the structural features of the image forming apparatuses in the first to third preferred embodiments, the following may be said. In a case where the period from the end of the formation of the last image to the starting of the shielding of the photosensitive drum from the primary charging device 2, transfer charging device, and separating charging device 6, by the charging device shutter 10 is shorter than the period from the end of the formation of the last image to the starting of the low electric power consumption mode, the peripheral surface of the photosensitive drum is rubbed by the cleaning blade 7*a*, and also, the charging device shutter 10 is driven. That is, in a case where the time at which the shielding operation by the charging device shutter 10 is started comes before the time at which the low electric power consumption mode is started, the period from when the photosensitive drum 1 becomes completely shielded by the charging device shutter 10 to the starting of the next image forming operation is longer. This is why the photosensitive drum is rotated for cleaning, and is shielded by the charging device shutter 10. On the other hand, based on the structural features of the image forming apparatuses in the first to third preferred embodiments, the following can also said. In a case where the period from the end of the formation of the last image to the starting of the shielding of the photosensitive drum by the charging device shutter 10 is longer than the period from the end of the formation of the last image to the starting of the low electric power consumption mode, the peripheral surface of the photosensitive drum is not rubbed by the cleaning blade 7*a*. That is, in a case where the time at which the shielding operation by the charging device shutter 10 is started comes after the time at which the low electric power consumption mode is started, the period from when the photosensitive drum 1 becomes completely shielded by the charging device shutter 10 to the starting of the next image forming operation is shorter, and therefore, the photosensitive drum 1 is not rotated for cleaning. That is, in a case where the photosensitive drum 1 is not rotated for cleaning during the period from the starting of the low electric power mode to the starting of the formation of the next image, the next image forming operation can be started earlier than in a case where the photosensitive drum 1 is rotated for cleaning during the period from the starting of the low electric power consumption mode to the starting of the next image forming operation. Further, the cleaning blade 7*a* and charging device shutter 10 lasts longer than in a case where the cleaning blade 7*a* and charging device shutter 10 are driven throughout the period from the end of the formation of the last image to the starting of the next image forming operation in order to prevent the electrical charge from draining from the peripheral surface of the photosensitive drum 1 by a significant amount after the photosensitive drum 1 is charged for image formation. Further, the image forming apparatus increases in productivity, because the cleaning blade 7*a* and charging device shutter 10 are not driven during the period from the starting of the low electric power mode to the starting of the next image forming operation.

Incidentally, instead of structuring the image forming apparatus as described above, the image forming apparatus may be structured so that in a case where the period from the end of the formation of the last image to the starting of the shielding by the charging device shutter 10 is longer than the period from the end of the formation of the last image to the starting of the low electric power consumption mode, neither does the cleaning blade 7*a* rub the photosensitive drum 1, nor is the charging device shutter 10 driven.

In the first to third preferred embodiments, the photosensitive drum 1 is shielded from the primary charging device 2, transfer charging device 5, and separation charging device 5 by the charging device shutter 10. However, this setup is not mandatory. That is, the image forming apparatus may be structured so that the photosensitive drum 1 is shielded from one or two charging devices from among the three charging devices 2, 5, and 6, because it is reasonable to think that even if the number of the charging devices from which the photosensitive drum 1 is shielded by the charging device shutter 10 is one or two, the draining of electrical charge from the photosensitive drum 1 will be better prevented than in a conventionally structured image forming apparatus, and therefore, the image forming apparatus in accordance with the present invention will form an excellent image, that is, an image which is not unexpectedly blurry and/or dim. Further, in the above described first to third embodiments, the cleaning blade 7*a* is a part of the cleaning device 7, and is a member which also is used during an image forming operation. However, the cleaning blade 7*a* is not limited to the usage in the above embodiments. That is, the image forming apparatus may be structured so that the cleaning blade 7*a* is independent from the cleaning device 7, and is used to prevent the occurrence of the draining of electric charge, by a significant amount, from the photosensitive drum after the charging of the photosensitive drum for image formation. Further, the setup may be a combination of the structural features in the first to third embodiments. For example, the "period from the end of the formation of the last image to the starting of the low electric power consumption mode", "period from the end of the formation of the last image to the starting of the shielding of the photosensitive drum from the primary charging device 2, transfer charging device 5, and separation charging device 6", may be established in a certain manner, and then, the period in which the toner on the photosensitive drum is removed by the cleaning blade 7*a* may be changed in length based on the length of the abovementioned periods. In other words, the image forming apparatus may be structured so that the above described technologies in the first to third preferred embodiments can be used in combination as needed.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 304029/2008 and 235086/2009 filed Nov. 28, 2008 and Oct. 9, 2009, respectively, which are hereby incorporated by reference.

What is claimed is:

1. An image forming apparatus comprising:

a rotatable photosensitive member;

a corona charger provided with an opening opposed to a surface of said photosensitive member;

an image forming device configured to form a toner image on said photosensitive member;

a shutter configured to open and close said opening relative to said photosensitive member;

a sliding device configured to remove a byproduct of an electrical discharge of said corona charger from said photosensitive member when said sliding device is in sliding contact with said photosensitive member; and a control device configured to control an operation of said image forming apparatus, wherein said control device is configured to control said image forming apparatus so as to stop rotation of said photosensitive member with said shutter kept opened after completion of image formation, and wherein in a case that said opening is to be closed after the stop of the rotation of said photosensitive member, said control device rotates said photosensitive member to remove the byproduct from said photosensitive member by said sliding device, immediately before, during or immediately after said shutter closes said opening.

2. An apparatus according to claim 1, further comprising a measuring device configured to measure a time duration, wherein when said measuring device measures a predetermined time duration from the completion of image formation, said control device is configured to control said shutter to close said opening.

3. An apparatus according to claim 1, further comprising a switching device for manually closing said shutter.

4. An apparatus according to claim 1, further comprising a setting device configured to variably set a time duration from the completion of image formation to start of a closing operation of said shutter, wherein said control device is configured to start rotation of said photosensitive member on the basis of the time duration set by said setting device such that said photosensitive member rotates in contact with said sliding device.

5. An apparatus according to claim 1, further comprising an obtain device configured to obtain information relating to use of said image forming apparatus, wherein said control device is configured to start rotation of said photosensitive member such that said photosensitive member rotates in contact with said sliding device.

6. An apparatus according to claim 1, further comprising a storing device configured to store a relation between the time elapsed from an end of image formation and a time during which said photosensitive member is rotated, wherein said control device is further configured to rotate said photosensitive member in contact with said sliding device for a time duration determined from the relation stored in said storing device.

7. An apparatus according to claim 1, wherein said sliding device includes a cleaning blade provided so as to be contactable to said photosensitive member.

8. An apparatus according to claim 1, wherein said shutter is movable to open and close said opening in a direction along a rotational axis of said photosensitive member, and wherein said control device is configured to rotate said photosensitive member, upon closing said shutter, for a time duration longer than a time duration required for closing said opening.

9. An image forming apparatus according to claim 1, further comprising a receiving device for receiving a user instruction of shifting the apparatus to a rest state, wherein said control device is further configured to control said image forming apparatus on the basis of an output of said receiving device such that said shutter is closed and said photosensitive member is rotated in contact with said sliding device.

10. An image forming apparatus comprising:

a rotatable photosensitive member;

a corona charger provided with an opening opposed to a surface of said photosensitive member, image forming means configured to form a toner image on said photosensitive member;

a shutter configured to open and close said opening relative to said photosensitive member;

sliding means configured to remove a byproduct of an electrical discharge of said corona charger from said photosensitive member when said sliding means is in sliding contact with said photosensitive member; and control means configured to control an operation of said image forming apparatus, wherein said control means is configured to control said image forming apparatus so as to stop rotation of said photosensitive member with said shutter kept opened after completion of image formation, and wherein in a case that said opening is to be closed after the stop of the rotation of said photosensitive member, said control means rotates said photosensitive member to remove the byproduct from said photosensitive member by said sliding means, immediately before, during or immediately after said shutter closes said opening.

* * * * *